United States Patent [19]

Riley

[11] 4,226,058

[45] Oct. 7, 1980

[54] ANCHOR FOR ROOF MOUNTED EQUIPMENT

[75] Inventor: James P. Riley, Phoenix, Ariz.

[73] Assignee: Goettl Air Conditioning, Inc., Phoenix, Ariz.

[21] Appl. No.: 957,988

[22] Filed: Nov. 6, 1978

[51] Int. Cl.[2] ..... E04F 19/00

[52] U.S. Cl. ..... 52/27; 52/478; 52/486; 52/698; 248/237

[58] Field of Search ..... 52/27, 483, 478, 486, 52/698, 550; 85/1 H; 248/339, 222.2, 237

[56] References Cited

U.S. PATENT DOCUMENTS

| | | | |
|---|---|---|---|
| 2,611,458 | 9/1952 | Hammitt et al. | 52/478 X |
| 3,456,412 | 7/1969 | Decombas | 52/486 |

FOREIGN PATENT DOCUMENTS

| | | | |
|---|---|---|---|
| 1025605 | 3/1958 | Fed. Rep. of Germany | 52/698 |

*Primary Examiner*—Alfred C. Perham

*Attorney, Agent, or Firm*—Cahill, Sutton & Thomas

[57] ABSTRACT

An anchor bolt for securing a bracket to a roof supported by a beam is disclosed. The anchor bolt includes a shank having a threaded upper end and a lower end and extends through a hole in the roof located adjacent the beam. A nut threaded onto the threaded upper end is tightened against the bracket to draw the bracket securely against the upper surface of the roof. The shank extends through the hole along a first side of the beam to a lower edge of the beam. The anchor bolt includes a hooked section attached to the lower end of the shank for anchoring the anchor bolt to the lower edge of the beam. The hooked section includes a retaining end for extending along a second side of the beam to prevent the hooked section from slipping off of the lower edge of the beam when the nut is tightened against the bracket. The retaining end is inclined with respect to the shank by an angle selected to permit the hooked end of the shank to be conveniently passed through the hole from the outside surface of the roof.

5 Claims, 7 Drawing Figures

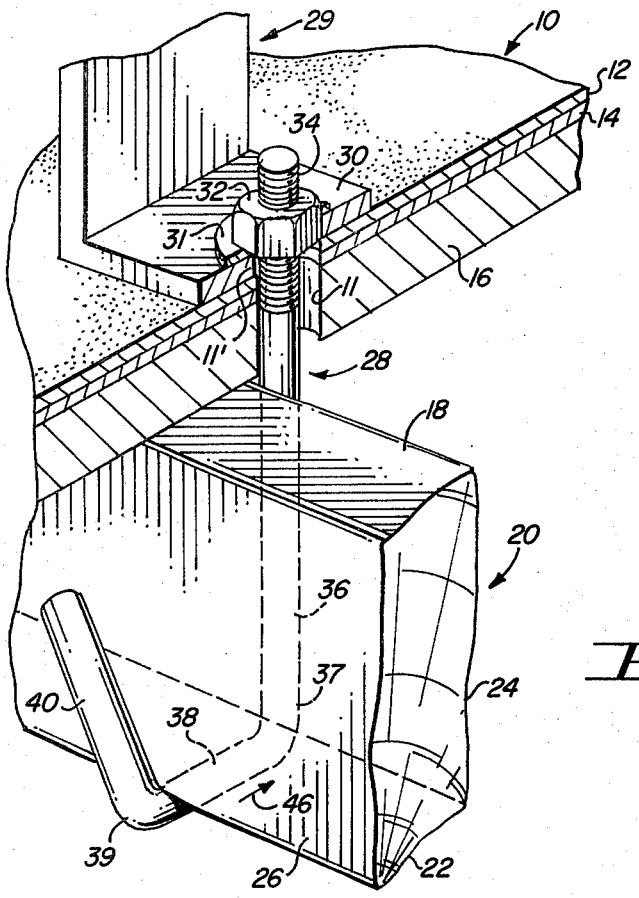
FIG. 1
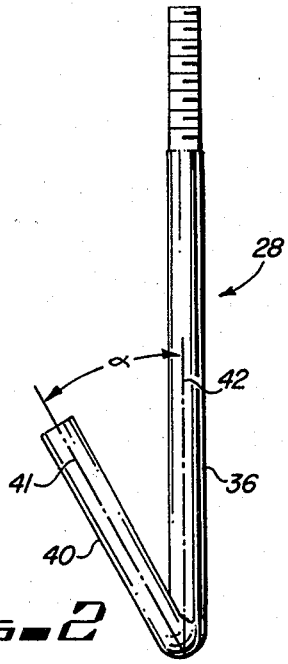
FIG. 2
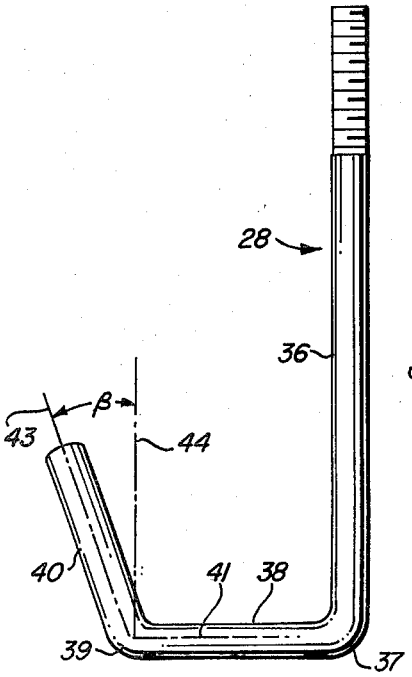
FIG. 3
FIG. 4A
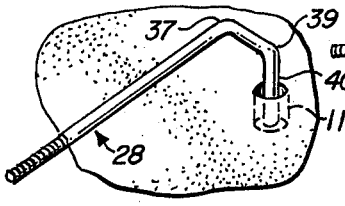
FIG. 4B
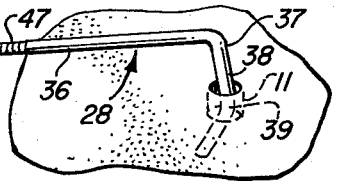
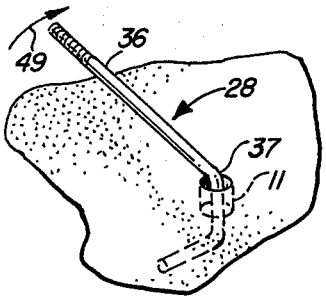
FIG. 4C
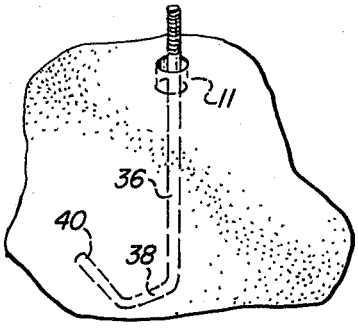
FIG. 4D

ANCHOR FOR ROOF MOUNTED EQUIPMENT

BACKGROUND OF THE INVENTION

1. Field of the Invention

The invention relates to apparatus for anchoring equipment to supporting surfaces, and more particularly, to anchor bolts which can be extended through a hole in the supporting surface to engage a joist or rafter which holds the supporting surface on which the equipment is to be mounted.

2. Description of the Prior Art

Frequently it is necessary to install massive units, such as air conditioners, solar collectors, parabolic antennas, and the like on roofs of pre-existing residential and/or commercial buildings. Since very high winds occasionally occur in practically all localities, it is obviously necessary that such equipment be very securely anchored to a roof upon which it is installed. Ordinarily, the anchoring means must be attached in some manner to the rafters or joists (hereinafter referred to as "beams") supporting the roof. One approach to attaching mounting brackets associated with equipment to be installed on a roof is to screw threaded lag bolts through the roof covering and sheathing into the supporting beams. However, this approach tends to weaken the beams somewhat. Further, lag bolts have a tendency to gradually become loosened as a result of local temperature and humidity variations and the cumulative effect of repetitive wind forces on the installed equipment. Once a lag bolt becomes loosened, it can be easily torn loose from the beam. Various other devices have been utilized to anchor equipment to roofs. One such device is a J-bolt having a shank threaded at one end and a hook at the opposite end. The threaded end of the shank of the J-bolt is commonly inserted from the underside of a roof through a hole in the roof adjacent a supporting beam. The hooked end of the J-bolt is looped beneath the supporting beam by a worker in the attic of the building. Meanwhile, a worker on top of the roof ensures that the threaded end of the shank passes through a hole or notch in a mounting bracket for supporting the equipment and places a washer and a nut on the threaded end. The nut is then tightened so that the hooked end of the J-bolt is drawn tightly against the underside of the supporting beam, thereby producing a counter-force on the nut, drawing the mounting bracket tightly against the roof surface. The necessity of inserting the threaded ends of the prior J-bolts from the under side of the roof through the holes therein is a time consuming and costly inconvenience, especially in flat roofed buildings of the type which have no attic (such flat roofed buildings are common in the Southwestern part of the United States). Thus, there is an unmet need for a convenient means of securely anchoring equipment on roofs of buildings.

Accordingly, it is an object of the invention to provide a convenient means of anchoring equipment to the roof of a building without the necessity of having a worker insert bolts from the underside of the roof through holes in the roof.

Another object of the invention is to provide an anchor for anchoring equipment to the roof of a building without weakening joists or rafters supporting the roof.

Still another object of the invention is to provide a means of anchoring equipment to the roof of a building by engaging joists and rafters which does not weaken as a result of repetitive weather variations.

SUMMARY OF THE INVENTION

Briefly, described, and in accordance with one embodiment thereof, the invention provides an anchoring device for anchoring an object to a support surface which is held by a beam or the like. The anchoring device includes a shank portion having a connecting element at one end for engaging the object to be anchored and a hooked end portion at the other end for engaging a back side of the beam. The shank portion of the achoring device extends through a hole in the support surface located adjacent the beam. The hooked portion includes a portion extending approximately perpendicularly to the shank portion across the backside of the beam and an end portion extending from the back side of the beam generally toward the support surface for preventing the hooked end from slipping off of the back end of the beam when the anchoring device is tightened to draw the hooked end tightly against the back side of the beam. The end portion and the intermediate extending portion lie in a first plane which is inclined at a first angle with respect to a second plane; the shank portion and the intermediate extending portion of the anchoring device lie in the second plane. The first angle and the diameter of the hole through the support surface are selected so that the end portion, intermediate extending portion, and shank portion of the anchoring device can be sequentially inserted through the hole in the support surface from the side of the support surface to which the object is to be anchored. The end portion is inclined outward at a second angle with respect to the intermediate portion to facilitate positioning of hooked end portion of the anchoring device to engage the back side of the beams as well as to facilitate insertion of the anchoring device through the hole in the support surface.

BRIEF DESCRIPTION OF THE DRAWINGS

FIG. 1 is a partial perspective view illustrating the anchoring device of the present invention and its use to anchor an object to a roof.

FIG. 2 is a side view of a portion of the anchoring device of FIG. 1.

FIG. 3 is another side view perpendicular to the side view of FIG. 2.

FIGS. 4A–4D are a sequence of perspective view diagrams illustrating insertion of the anchoring device of FIG. 1 through a hole in a roof.

DESCRIPTION OF THE INVENTION

Referring now to the drawings, and particularly to FIG. 1, roof 10 includes a layer of roofing material 12, which may be comprised of asphalt shingles, roofing, or the like. A layer of felt material 14 underlies roofing material 12. Felt material 14 lies upon wood sheathing 16. Sheathing 16 is supported on upper surface 18 of beam or joist 20.

A large object (not shown) such as an air conditioning unit, solar collector, or the like, mounted on roof 10 has a support bracket 29 which extends to the upper surface of roof 10. Bracket 29 includes a horizontal plate 30 which rests on the upper surface of roof 10 (it is assumed in this discussion that roof 10 is approximately horizontal; however, roof 10 can obviously slope, in which case plate 30 of bracket 29 would also be sloped).

Plate 30 has a hole 11′ therein to permit attaching of bracket 29 to roof 10. Roof 10 has a hole 11 aligned with hole 11′ of bracket 29.

Anchor bolt 29 includes a shank portion 36 having an upper threaded end 34 extending through hole 11. Hole 11 is positioned adjacent a first side 24 of beam 20, so that shank portion 36 extends along first side 24.

Anchor bolt 28 has a hooked end including bend 37, an intermediate portion 38 (which extends along lower surface 22 of beam 20), a bend 39, and an end portion 40 (which extends generally toward the lower surface of roof 10 along side 26 of beam 20).

It can be seen readily that when nut 32 is threaded onto threaded end 34 of shank portion 36 and is tightened against washer 31, forcing washer 31 against the upper surface of bracket plate 30, an outward force is transmitted by means of shank portion 36 to intermediate portion 38, which produces an upward counter force against under side 22 of beam 20, thereby tightly securing support bracket 29 to beam 20.

It can be seen that end portion 40 prevents intermediate portion 38 from slipping along under surface 22 in the direction indicated by arrow 46. It can be shown by a mechanical analysis that a component of force in the direction indicated by arrow 46 exists on intermediate portion 38. This force would be countered only by a frictional force between under surface 22 and intermediate extending portion 38 if it were not for the retaining action of end portion 40. It can be seen that there would be a pronounced tendency for intermediate portion 38 to slide in the direction indicated by arrow 46, especially upon occurrence of vibrations which would normally occur in roof 10 and beam 20 if end portion 40 were omitted. It is noteworthy that such vibrations are normally produced in buildings by wind, sound shock waves, and by vibrating mechanical equipment mounted in the building or on its roof.

Referring now to FIG. 2, end portion 40 and intermediate portion 38 lie in a first plate. Shank portion 36 lies in a second plane which also contains intermediate portion 38. Reference numerals 41 and 42 in FIG. 2 represent the edges of the first and second planes, respectively. Angle $\alpha$ measured between planes 41 and 42, is selected to permit convenient insertion of anchor bolt 28 through hole 11 from the outside surface of roof 10.

Referring next to FIG. 3, reference numeral 43 designates an axis of end portion 40, reference numeral 41 indicates an axis of intermediate portion 38, and reference numeral 44 represents a line perpendicular to axis 41 and coplanar with axis 43. Angle$\beta$, measured between axis 43 and line 44, is selected to facilitate engaging the hooked end of anchor bolt 28 with the under side 22 of beam 20 as well as to facilitate insertion of anchor bolt 28 through hole 11 from the outside surface of roof 10.

The operation of inserting anchor bolt 28 into hole 11 of a roof is most easily explained by referring to FIGS. 4A–4D. Referring to FIG. 4A, angles $\alpha$ and $\beta$ are sufficiently large that end portion 40 can be inserted into hole 11. Obviously, this could not be done if end portion 40 were coplanar with intermediate section 38 and shank portion 46. Next, shank portion 36 is rotated upward in the general direction indicated by arrow 47, causing bend 39 to pass through hole 11, thereby causing intermediate section 38 to pass through hole 11, as indicated in FIG. 4B. Shank portion 36 is then rotated further, in the general direction indicated by arrow 49 in FIG. 4D, so that bend 37 passes through hole 11. Finally, shank portion 36 is passed through hole 11 and is rotated so that intermediate section 38 and end portion 40 engage a roof supporting beam, as indicated in FIG. 1.

The angles $\alpha$ and $\beta$ and the diameter of hole 11 are selected so that the above procedure is easily accomplished.

Various modifications to the anchor bolt 28 shown in the drawings can be made by those skilled in the art without departing from the spirit and scope of the described invention. For example, various other configurations of the hooked end portion of anchor bolt 28 could be utilized. For example, the hooked end could be implemented by means of a continuously curved end section wherein the extreme end portion is oriented at a suitable angle with respect to the direction of shank portion 36. And, of course, anchor bolt 28 can be utilized to anchor heavy devices to floors or walls, as well as to roofs.

I claim:

1. Anchoring apparatus for securing an object to a relatively thin support having an outer surface and an inner surface, the inner surface being held by a beam, the support having therein a hole adjacent the beam, the beam having a back side and first and second opposed sides, said anchoring apparatus comprising in combination:

a. connecting means for connecting said anchoring apparatus to the object to hold the object against the support;

b. a first elongated section having a first end connected to said connecting means for extending through said hole and transmitting a force pulling said connecting means toward the support, said first elongated section extending along a first side of the beam; and said first elongated section also having a second end; said first elongated section being substantially straight;

c. a second elongated section having a first end connected to the second end of said first elongated section for engaging a back side of said beam, said second elongated section extending approximately perpendicularly to said first elongated section; said second elongated section also having a second end; said second elongated section being substantially straight; said first and second elongated sections lying in a first plane; and d. a third elongated section having a first end connected to the second end of said second elongated section for extending beyond another side of the beam and toward the inner surface of the support to prevent said second elongated section from slipping off of the back side of the beam as a result of said force, said third elongated section being substantially straight and being inclined with respect to said first plane by a first angle, the first angle being selected so that said third, second and first elongated sections, respectively, can be sequentially passed through said hold from the outer surface of said support.

2. The anchoring apparatus of claim 1 wherein said first, second and third elongated sections are composed of a continuous rod.

3. The anchoring apparatus of claim 2 wherein said first end of said first elongated section is threaded, and wherein said connecting means includes a nut threaded onto said threaded first end.

4. The anchoring apparatus of claim 3 wherein said thin support includes roof surface material and sheathing and said beam is a rectangular rafter.

5. The anchoring apparatus of Claim 3 wherein said third elongated section is included with respect to a second plane by a second angle, the second plane being perpendicular to said second elongated section, said first and second angles both being selected together to enable said third, second and first elongated sections to be sequentially passed through said hole from the outer surface of the support.

* * * * *